United States Patent [19]

Murphy

[11] 4,448,551

[45] May 15, 1984

[54] METHOD AND APPARATUS FOR SHAFT SUPPORT FOR TURBINE PUMPS

[76] Inventor: Reuel A. Murphy, 5200 Cavitt Stallman Rd., Roseville, Calif. 95678

[21] Appl. No.: 5,993

[22] Filed: Jan. 24, 1979

Related U.S. Application Data

[63] Continuation-in-part of Ser. No. 897,573, Apr. 19, 1978, which is a continuation-in-part of Ser. No. 797,923, May 18, 1977, abandoned.

[51] Int. Cl.[3] ..... F16C 23/02

[52] U.S. Cl. ..... 384/252; 384/274

[58] Field of Search ..... 308/15, 4 A, 27, 37, 308/237 R, 244; 277/116.6, 119, 116.8, 120, 118; 384/272, 267, 268, 269, 274, 252

[56] References Cited

U.S. PATENT DOCUMENTS

| | | | |
|---|---|---|---|
| 1,557,767 | 10/1925 | Oliver | 308/4 A |
| 1,683,640 | 9/1928 | Weise | 277/116.6 |
| 2,465,425 | 3/1949 | Bower | 308/27 |
| 2,640,427 | 6/1953 | Domer | 308/15 |
| 3,009,747 | 11/1961 | Pitzer | 384/272 |
| 3,389,918 | 6/1968 | Burns | 277/119 |

FOREIGN PATENT DOCUMENTS

| | | | |
|---|---|---|---|
| 1518912 | 7/1978 | United Kingdom | 308/237 R |

*Primary Examiner*—Lenard A. Footland
*Attorney, Agent, or Firm*—Herbert C. Schulze

[57] ABSTRACT

This is a method for supporting a pump shaft, or the like, within a tubing wherein bearing supports are provided which can be inserted and removed from the tube for maintenance purposes, or the like, with or without disturbing the location of the tube, and wherein the method is practiced by utilizing expanding bushings within the tubing, which bushings will support a shaft extending through the bushings. The bushings are caused to clamp to the internal surface of the tubing by means of an expandable split sleeve as a part of each such bushing which is normally of a smaller size than the interior of the tubing, but which is caused to expand by having a tapered inner surface which is forced upward on a tapered supporting surface by means of a threaded sleeve and, thus, is caused to expand against the interior of the tubing.

1 Claim, 6 Drawing Figures

610
611
612
613
601
602
603
604
620
621
622
625
630
633
660
661

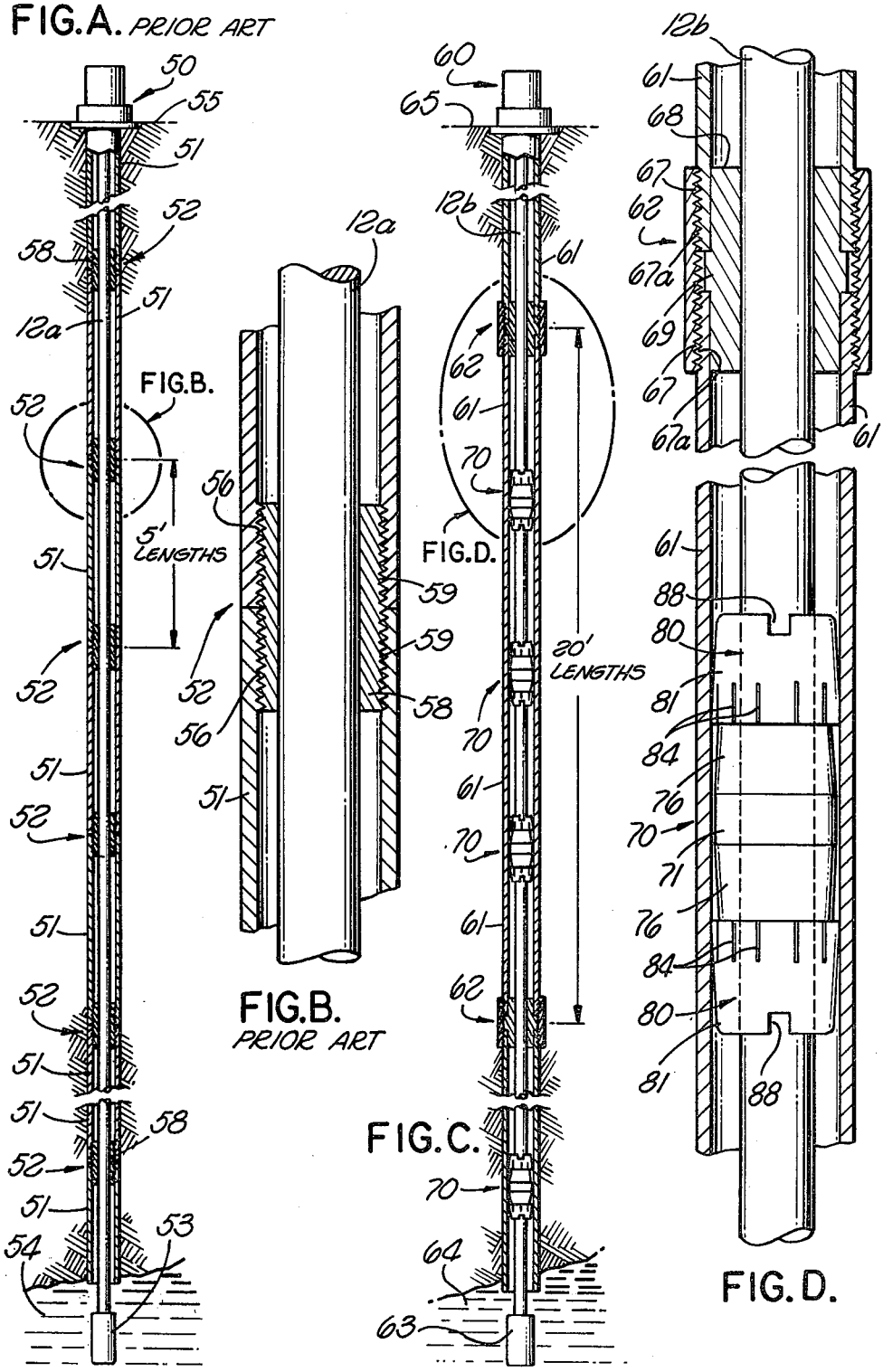
FIG.A. PRIOR ART
FIG.B.
5' LENGTHS
FIG.B. PRIOR ART
FIG.C.
FIG.D.
20' LENGTHS
FIG.D.

METHOD AND APPARATUS FOR SHAFT SUPPORT FOR TURBINE PUMPS

CROSS-REFERENCE TO RELATED PATENT APPLICATIONS

This application is related to, and is a continuation-in-part of my presently pending patent application Ser. No. 897,573, filed Apr. 19, 1978, for METHOD AND APPARATUS FOR SHAFT SUPPORT FOR TURBINE PUMPS, which, in turn, is a continuation in part of U.S. patent application Ser. No. 797,923, filed May 18, 1977, now abandoned.

BACKGROUND OF THE INVENTION

1. Field of the Invention

This invention relates to a method for supporting shafts within a protective tube, or housing, and is more particularly related to such a condition wherein the shaft is a shaft utilized to operate a turbine pump beneath the ground, as for example, in deep wells, wherein the shaft is protected by an exterior tubing surrounding it, or other such conditions where a shaft is desired to be operated within an exterior tubing.

It is even more particularly related to such a condition wherein the exterior tubing is quite elongated and consists of more than one section of tubing joined together.

This invention further is in the field of such a method as mentioned wherein the shaft is supported by bushings, or bearings, which are mounted in the tube for the support of the shaft.

2. Description of the Prior Art

I know of no prior art directly reading upon my method and particular apparatus for practicing the method.

However, I do know that there have been some developments in the bushing and bearing field which might be considered related, but certainly not anticipatory of this invention. For example, each of the following United States patents may be considered of interest, but not anticipating the present invention: U.S. Pat. Nos. 3,984,152; 3,150,900; 3,829,184; 3,637,269; 3,359,047; 3,455,619; and 2,755,111. The above referenced patents and the other general prior art in this field includes such bearings as customary bronze bearings, or the like, babbited bearings, bearings within enclosures incorporating lubricating facilities, and the like.

None of these bearings, however, include the use of removable self-centering bushings which may be fixed in place within a tube where desired and removed from such tube as desired by means of appropriate and unique insertion and removal tool apparatus and method.

SUMMARY OF THE INVENTION

There are many uses for drive shafts of one type or another which must rotate, and in which it is desired to encase the entire drive shaft within a tubing for protection of the shaft from interference from exterior causes, from contact with adverse environmental conditions, and the like. One of the most interesting and important of such uses is in the field of pumps of various types, and particularly pumps utilized in agricultural water pumping from deep wells, and the like. Those skilled in the art will be familiar with a number of such pumps.

Most of the pumps of this nature are activated by a motor mounted above the ground and operate the pump itself, having its pumping parts located far beneath the ground surface. The connection between the pumping elements and the motor is usually by an elongated shaft running within a casing, or tube, to protect the shaft from collapse of the dirt or other material surrounding it.

Where an elongated shaft is utilized in this manner, it becomes necessary to support it by bearing surfaces at relatively short intervals. As will be known to those skilled in the art, if such a shaft is not appropriately supported, it will not function properly.

The necessity of the appropriate bearing surfaces has led to the utilization of a number of expensive methods of construction for such uses as turbine pump shafting, or the like, where it is desired to enclose an elongated shaft within a tubing.

Perhaps the most common method now used is to utilize short lengths of tubing (customarily about 5 feet long) with an internal thread on each end of each tube, and an externally threaded bronze bushing, or the like, which is utilized both for the shaft support and to join the short sections together.

If the bushings must be removed or replaced, it is necessary, of course, to uncouple the pipes thus joined and remove the tubing after the shaft has been removed. This is a costly process and the short lengths of pipe in themselves create an excessive amount of difficulty in joining together and mounting. Additionally, in the case of very long shafts with their surrounding tubing, an excessive strain is placed upon the bronze bushings which are supporting the length of the tubing.

I have studied this overall problem and have now developed a complete method and apparatus for performing the method whereby long lengths of tubing may be utilized, and wherein, if lengths of tubing are joined together, they may be joined appropriately by an exterior load bearing coupling wherein no strain is placed upon the bushings themselves.

Additionally, I have designed self-centering bushings in which the exterior of the bushing expands by proper insertion in such manner that it contacts and presses against the interior of the tubing in which it is mounted.

One of the devices I have constructed for this purpose includes a central bushing member having threaded external ends and tapered portions which cooperate with split expandable rings or collars which are threaded on to the bushing and expanded in such manner that the segments caused by the splitting of the ring enter into compressive engagement against the inner surface of the tube.

As a result of recent further development and invention, I have now devised a new and simplified bushing for this purpose wherein there is only a single expandable sleeve about an inner tapered bushing member, which expandable sleeve is expanded by sliding along a tapered inner surface and is forced to mate with the interior of the tubing by means of a single threaded nut.

I have also devised a method of inserting such expanding bushings within the tubing and removing the same from within the tubing without necessarily disjoining the tubing and without the necessity of any external interference except from one end of the tubing with an elongated special means to effect the fixing by compression of the bushing in the desired location and the removal thereof.

An object of this invention is to provide a means for supporting a rotatable shaft within an elongated tubular housing wherein removable bushings are utilized.

Another object of this invention is to provide such a method and apparatus as herein described which will be particularly adapted to use with deep well turbine pumps.

Another object of this invention is to provide a self-centering bushing which will be capable of clamping itself into a position within a tubing to support a shaft therein.

Another object of this invention is to provide a method for inserting and removing the bushings referred to above without necessarily disturbing or disjointing the elongated tubing within which the shaft is mounted.

Other objects and advantages of this invention will become apparent to those skilled in the art upon reading the following description of a preferred embodiment in conjunction with a review of the appended drawings.

BRIEF DESCRIPTION OF THE DRAWINGS

FIG. A illustrates a turbine pump drive shaft according to the past and prior art;

FIG. B is an enlarged partial section on the area illustrated at a joint on FIG. A;

Figures 1, 2:
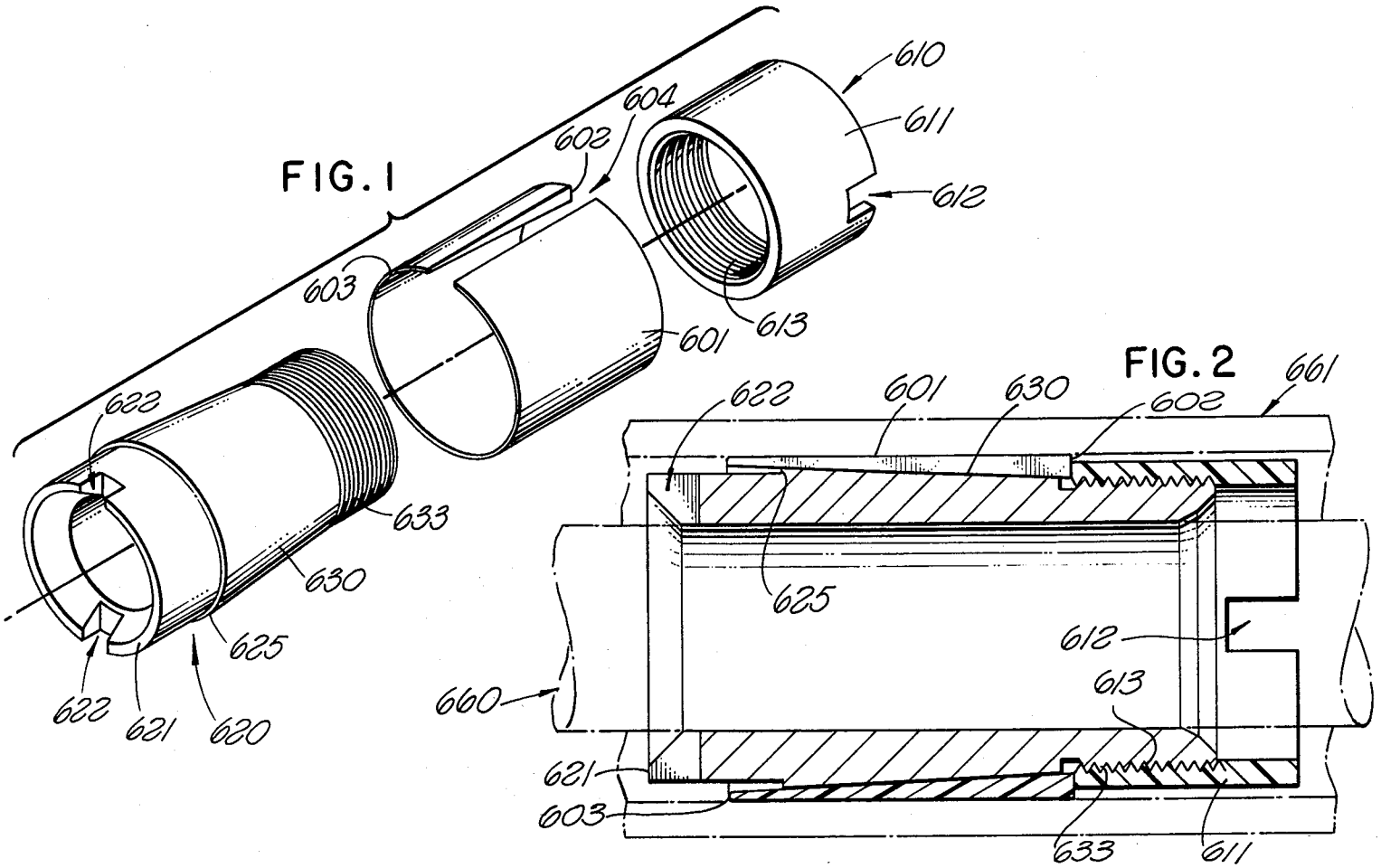

FIG. C illustrates an installation of a turbine pump similar to that of FIG. A, but in which the shaft is supported by the method and apparatus of this invention;

FIG. D is an enlarged partially sectioned view on the section indicated in FIG. C at a joint area and broken away to show a removable bearing.

FIG. 1 is an exploded view of my most recently developed preferred embodiment of a bushing for use in the method of this invention; and FIG. 2 is a sectional view of the device of FIG. 1 when assembled and in place within a tubing and supporting a shaft wherein both the shaft and the tubing are shown in phantom.

DESCRIPTION OF A PREFERRED EMBODIMENT

In the general field of endeavor involved, and particularly in the field of endeavor of deep well turbine pumps, FIG. A illustrates the most preferred past known method, and thus the prior art, of mounting a shaft within a greatly elongated tubular member. FIG. B is an enlarged partial section of a portion of FIG. A, and in particular the area about one joint between tubing lengths. A pump motor, or the like, 50 is mounted generally at ground level 55. A shaft **12*a* is mounted within a tube, or pipe, which consists of a series of short sections 51. Each of the sections 51 is joined at 52 to a like section 51. In the customary past art, each section of tubing 51** is normally approximately 5 feet.

The shaft ultimately terminates within the liquid area 54 and at the pumping elements 53. This will be understood by those skilled in the art.

Each joint 52 has a bushing 58, generally a bronze bushing, which has a threaded exterior 59. The threaded exterior 59 is such that the two mating tubing sections 51, being threaded on their interior surfaces at 56, will be joined and held together by threading upon the bronze, or the like, bushing 58.

In any disassembly of the entire unit or any portion thereof, it is obviously necessary to totally disassemble in order to remove, repair, or replace the bushings 58 which are the bearing surfaces for the shaft **12*a***.

With attention now directed to FIGS. C and D, the present invention and its advantages will become clear. A motor, or the like, 60 is mounted once again at ground level 65. The shaft **12*b* extends downward to the pumping elements 63 within the fluid 64** beneath the ground.

In this case, the individual lengths of pipe 61 may be of any desired length, and will preferably be 20 or 40 feet in length. Such lengths of pipe are joined as at 62 generally.

It will be observed in FIG. D that a bushing, which may be bronze or other suitable bearing material 68 which has a flange, or the like, at 69, with no threads, is at each joint.

Each length of pipe will be customarily threaded on the exterior surface thereof at 67, and a customary coupling, or the like, 66 will join the pipes together, pressing against the flange 69 as illustrated.

At 5 foot intervals within the longer lengths of pipe there will be inserted a bearing of this invention such as illustrated generally at 70 in FIG. D. It must also be understood that it is not necessary to have the bearing 68 at the actual joint of pipes, but a bearing similar to that shown in FIG. D at 70 can also be inserted with the pipes completely joined together with the coupling and without the bearing having any structural purpose as far as the pipe lengths are concerned, but only the purpose of supporting the shaft **12*b***.

Tubing 61 is illustrated with the bushing, generally 70, in place, but not fixed against the inner walls of the tubing. The bushing is seen to consist of a main body portion 71 having an interior bore 87, with oil grooves 73. There are two exterior tapered areas 76, as indicated, and the ends are threaded at 77. Two like collars, each generally 80, are utilized in conjunction with the body 71. These collars are threaded at 87 with threads that match and cooperate with threads 77. A number of tabs 84 are formed by reason of the slots 85 on the collar. The collar is made of material which is flexible enough that these tabs will flex outwardly when the collars 80 are tightened upon the main bearing portion 71. Each collar 80 may have a pair of slots, as at 88, for engagement by a tool which can be utilized for fastening the collars as will be explained below.

It will be observed that both the collars and the body of the bushing have chamfered edges at 83 and 75 to facilitate the entrance of a shaft or tool through the collars and the bushing without damaging the bearing surfaces.

It will be noted that there is an opening 74 in the side wall of the bearing portion 71 and that the tubing 61 has been drilled and tapped to accommodate the pin 79, or the like. This is not a necessary part of the invention, but may be found useful in some instances for the purposes of holding a bushing in place prior to expanding it into intimate contact with the tubing.

In a more simplified form of bushing which can be used interchangeably with the bushing shown generally as 70 in FIG. D, three elements are shown in FIG. 1 to consist solely of a main bushing portion 620, including a basic cylindrical member, having a chamfered portion adjacent its upper edge to facilitate entry of a shaft, and a substantial shoulder 621 for strength. A pair of slots 622 are shown which may be utilized with an insertion tool as is described in my previously referred to, copending application.

A tapered exterior portion of the main bushing is shown at 630, having a shoulder 625 at its upper terminal. A threaded portion 633 depends from the lower edge of the bushing member.

A sleeve 601 is then shown, which sleeve tapers from a heavier lower portion 602 to a thinner upper portion 603 and has a slot 604 provided over its length. The end piece 610 has a threaded interior 613 suitable to accommodate the threads on piece 633 of the bushing. The body 611 is preferably cylindrical in shape, as shown, with slots 612 to facilitate turning with a tool such as is described in my previously referenced, copending application, or the like.

In use, the sleeve 601 is slipped onto the exterior of the bushing as is shown particularly well in FIG. 2. The collar 611 is threaded onto the end of the bushing and the threads 613 and 633 make it possible to force the split bearing member 601 upward on the tapers along the area 630 until its exterior surface presses tightly against the pipe or tubing 661. The shaft 660, of course, is inserted within the bushing and is supported by it.

While the embodiment of this invention, specifically shown and described, is fully capable of achieving the objects and advantages desired, it is to be understood that such embodiment has been shown for purposes of illustration only and not for purposes of limitation.

I claim:

1. An expandable bushing for use within a tubing for purposes of supporting a shaft within said bushing and within said tubing comprising in cooperative relationship: a first elongate tubular member having an interior surface suitable to support a rotatable shaft and an exterior surface including a tapered portion and having threads adjacent one end and having slots suitable to be engaged by a tool; a second elongate tubular member having an opening extending its length, and having an interior tapered surface suitable to slide upon the tapered surface upon the first tubular member, in such manner as to expand outwardly; and means to force said second tubular member to slide upon first tubular member to cause expansion of said second tubular member and to hold the same in an expended figuration; and threaded collar means having slots suitable to be engaged by a tool for the purpose of threading said collar means upon said first tubular member in such manner as to mount upon the threads of said first tubular member and by turning said collar means forcing the said second tubular member to slide upon the said first tubular member.

* * * * *